US012624608B1

(12) United States Patent
Yu et al.

(10) Patent No.: US 12,624,608 B1
(45) Date of Patent: May 12, 2026

(54) RUNNING TOOL FOR TUBING HANGER

(71) Applicant: WEFIC Ocean Equipment Manufacturing Co., Ltd., Dongying (CN)

(72) Inventors: Xiaotao Yu, Dongying (CN); Zhongfei Sui, Dongying (CN); Tao Wang, Dongying (CN); Juliang Ge, Dongying (CN); Huaguo Liu, Dongying (CN); Xu Chen, Dongying (CN); Wuhai Wang, Dongying (CN); Xiaoxiao Guo, Dongying (CN); Zhiqiang Zhang, Dongying (CN); Kun Li, Dongying (CN)

( * ) Notice: Subject to any disclaimer, the term of this patent is extended or adjusted under 35 U.S.C. 154(b) by 0 days.

(21) Appl. No.: 19/295,096

(22) Filed: Aug. 8, 2025

(30) Foreign Application Priority Data

Jan. 21, 2025 (CN) ..... 202510093438.7

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 43/10
See application file for complete search history.

(56) References Cited

U.S. PATENT DOCUMENTS 6,401,827 B1 * 6/2002 Ferguson ..... E21B 23/02 166/212
11,773,668 B2 * 10/2023 Lim ..... E21B 33/04 166/382
2002/0062957 A1 5/2002 Reilly
2004/0104024 A1 * 6/2004 Kent ..... F16K 3/02 166/368
2010/0326664 A1 * 12/2010 Neto ..... E21B 33/04 166/123
2016/0177652 A1 * 6/2016 Thornburrow ..... E21B 33/04 166/85.1
2018/0258727 A1 * 9/2018 Lim ..... E21B 33/0422

FOREIGN PATENT DOCUMENTS

CN 205638307 U 10/2016
CN 112324371 A 2/2021
CN 114737903 A 7/2022

OTHER PUBLICATIONS

Wan Chunyan et al, <Hydraulic-Control Deep Water Tubing Hanger Running and Retrieving Tool> China Petroleum Machinery, Dec. 10, 2019, pp. 64-68, vol. 47, No. 12.

* cited by examiner

*Primary Examiner* — James G Sayre

(57) ABSTRACT

A running tool for a tubing hanger relates to the field of the tubing hanger salvage technology, the running tool includes a body, a first piston is movably provided on the body, and the first piston is provided with a first abutting portion; a second piston is movably provided on the body, on one side of the second piston, a second abutting portion, a first stopping portion, and a first docking piece cooperating with the tubing hanger are sequentially provided along a first direction; the first docking piece is positioned on a moving track of the triggering portion; a second stopping portion is positioned on a moving track of the first stopping portion. The first stopping portion and the second stopping portion cooperate to form a stopping pair.

9 Claims, 7 Drawing Sheets

RUNNING TOOL FOR TUBING HANGER

CROSS-REFERENCE TO RELATED APPLICATION

This patent application claims the benefit and priority of Chinese Patent Application No. 202510093438.7, entitled "RUNNING TOOL FOR TUBING HANGER" filed with the China National Intellectual Property Administration on Jan. 21, 2025, the disclosure of which is incorporated by reference herein in its entirety as part of the present application.

TECHNICAL FIELD

The present disclosure relates to the field of the tubing hanger salvage technology, in particular to a running tool for a tubing hanger.

BACKGROUND

The tubing hanger is one of the indispensable equipment in the process of the oil drilling and the oil extraction. Its main function is to support the tubing string, seal the annular space between the tubing and the casing, and provide a transition for connecting the lower casing head to the upper subsea tree.

In the prior art, during the process of lowering the tubing hanger and retrieval the tubing hanger, it is common for the tubing hanger to disengage from the lowering tool. If the tubing hanger disengages from the lowering tool, it will cause the tubing to fall off due to loss of support, resulting in damage to the tubing and even the ejection of the crude oil and other liquids, polluting the surrounding environment and injuring operators.

Therefore, how to ensure the stable connection between the tubing hanger and the running tool during the lowering process and/or the retrieval process, and avoid the disengagement of the tubing hanger during the lowering process and the retrieval process, has become an urgent technical problem to be solved by those skilled in the art.

SUMMARY

The objectives of the present disclosure is to provide a running tool for a tubing hanger, which ensures stable connection between the tubing hanger and the running tool during the lowering process and/or the retrieval process, avoiding the problem of the tubing hanger disengaging from the running tool during lowering process and the retrieval process and causing accidents.

In order to achieve the above objectives, the present disclosure adopts the following technical solutions.

The running tool for a tubing hanger provided by the present disclosure includes a body, wherein the body is sequentially provided with a first piston, a second piston, and a second stopping portion.

The first piston is movably provided on the body, the first piston is sequentially provided with a first abutting portion, a second abutting portion and a triggering portion along the first direction.

The second piston is movably provided on the body, the second piston is movably fitted with the first piston, the second piston is sequentially provided with a third abutting portion, a fourth abutting portion, a first stopping portion, and a first docking piece along the first direction. The fourth abutting portion and the first stopping portion are positioned on one side of the second piston close to the body, the first docking piece is positioned on one side of the second piston far away from the body, the third abutting portion is positioned on a moving track of the first abutting portion along the first direction, and the fourth abutting portion is positioned on a moving track of the second abutting portion along the second direction. The distance between the first abutting portion and the third abutting portion is not less than the distance between the disengaging position and the triggering position, the distance between the second abutting portion and the fourth abutting portion is greater than the distance between the disengaging position and the triggering position, and the first docking piece is positioned on a moving track of the triggering portion.

The second stopping portion is positioned on a moving track of the first stopping portion along the first direction.

If the running tool needs to be docked with the tubing hanger, a first acting force drives the first piston to move toward the first direction, and after the triggering portion reaches the triggering position, the first acting force passes through the first abutting portion, and the second abutting portion drives the second piston to move toward the first direction until the first docking piece reaches the docking position, and the first stopping portion and the second stopping portion form a stopping pair; then, a second acting force drives the first piston to move toward a second direction until the triggering portion reaches the disengaging position, and the first docking piece moves toward the direction close to the tubing hanger under a third acting force to form docking with the tubing hanger.

Wherein, the first direction is arranged from the first piston toward the tubing hanger; the first direction and the second direction are opposite. The disengaging position and the triggering portion are sequentially arranged along the first direction, if the triggering portion reaches the disengaging position, the first docking piece and the tubing hanger form docking or interference, and if the triggering portion reaches the triggering position, the first docking piece and the tubing hanger are arranged in an avoiding way under the action of the triggering portion.

Preferably, the running tool further includes a first driving piece and a second driving piece, the first driving piece can apply the first acting force to the first piston, and the second driving piece can apply the second acting force to the first piston.

Preferably, the first driving piece includes a first channel provided on the body and a first driving portion provided on the first piston, and two ends of the first channel are respectively communicated with the external working medium source and the first driving portion.

The second driving piece includes a second channel provided on the body and a second driving portion provided on the second piston, and two ends of the second channel are respectively communicated with the external working medium source and the second driving portion.

The first driving portion and the second driving portion are arranged independently.

Preferably, the body is provided with a separation assembly, and the separation assembly is positioned between the first driving portion and the second driving portion.

The running tool further includes a third driving piece that applies a force to the second piston toward the first direction if the triggering portion reaches the disengaging position.

Preferably, the tubing hanger includes a base body, a triggering piece and a second docking piece are sequentially provided on the base body from a third direction, the triggering piece is movably provided on the base body; one end of the triggering piece close to the running tool is provided with a first docking portion fitted with the first docking piece, and the second docking piece is positioned on a moving track of the triggering piece.

If the first driving piece drives the second piston to move toward the first direction, the triggering piece moves toward the direction close to the second docking piece, and the triggering piece locks the second docking piece with the subsea tree; the third direction is the direction in which the body faces the subsea tree.

Preferably, the body is sequentially provided with a first positioning portion and a second positioning portion along the first direction; the first positioning portion is positioned on the side of the first piston away from the first direction, the first positioning portion is positioned on the moving track of the first piston; and the second positioning portion is positioned on the side of the second piston facing the first direction, the second positioning portion is positioned on the moving track of the second piston.

Preferably, the first piston includes an external piston, a driving ring and a nesting ring which are sequentially arranged along the first direction, the nesting ring, the driving ring and the external piston are sequentially arranged from a direction close to the body toward a direction away from the body; the driving ring is respectively in threaded connection with the external piston and the nesting ring, the external piston and the nesting ring are in slide fit with the body.

And/or, the running tool includes a sealing assembly including a first sealing piece positioned between the body and the first piston, and a second sealing piece positioned between the body and the second piston.

And/or the first docking piece is a unitary structure.

Preferably, the first piston and the second piston are coaxially arranged with the body; the running tool further includes a detection assembly provided on the body, the detection assembly is used for detecting the inclination angles between the first piston, the second piston and the body; guide pieces are provided between both the first piston and the second piston and the body, and the guide piece is arranged along the first direction.

Preferably, the guide piece includes a guide rail arranged along the first direction; and/or the guide piece includes a balance cavity provided on one side of the first piston away from the body, and the balance cavity is communicated with an external pressure source.

Compared with the prior art, the present disclosure has achieved the following technical effects.

The running tool in the present disclosure includes a body, the body is sequentially provided with a first piston, a second piston, and a second stopping portion. The first piston is movably provided on the body, the first piston is sequentially provided with a first abutting portion, a second abutting portion and a triggering portion along the first direction. The second piston is movably provided on the body, the second piston is movably fitted with the first piston, the second piston is sequentially provided with a third abutting portion, a fourth abutting portion, a first stopping portion, and a first docking piece along the first direction. The fourth abutting portion and the first stopping portion are positioned on one side of the second piston close to the body, the first docking piece is positioned on one side of the second piston far away from the body, the third abutting portion is positioned on a moving track of the first abutting portion along the first direction, and the fourth abutting portion is positioned on a moving track of the second abutting portion along the second direction. The distance between the first abutting portion and the third abutting portion is not less than the distance between the disengaging position and the triggering position, the distance between the second abutting portion and the fourth abutting portion is greater than the distance between the disengaging position and the triggering position, and the first docking piece is positioned on a moving track of the triggering portion. The second stopping portion is positioned on a moving track of the first stopping portion along the first direction.

If the running tool needs to be docked with the tubing hanger, the first acting force drives the first piston to move toward the first direction, and after the triggering portion reaches the triggering position, the first acting force drives the second piston to move toward the first direction through the first abutting portion, and the second abutting portion until the first docking piece reaches the docking position, and the first stopping portion and the second stopping portion form a stopping pair; then, the second acting force drives the first piston to move toward a second direction until the triggering portion reaches the disengaging position, and the first docking piece moves toward the direction close to the tubing hanger under a third acting force to form docking with the tubing hanger.

Wherein, the first direction is arranged from the first piston toward the tubing hanger; the first direction and the second direction are opposite. The disengaging position and the triggering position are sequentially arranged along the first direction, if the triggering portion reaches the disengaging position, the first docking piece and the tubing hanger form docking or interference, and if the triggering portion reaches the triggering position, the first docking piece and the tubing hanger are arranged in an avoiding way under the action of the triggering portion.

It should be noted that, since the first piston and the second piston are in movable fit, and the distance between the first abutting portion and the third abutting portion is not less than the distance between the disengaging position and the triggering position, the first piston can move in the first direction relative to the second piston before the first piston drives the first docking piece to move toward the first direction to the docking position, so that the triggering portion can move to the triggering position, and the first docking piece and the tubing hanger are arranged in an avoiding way. Moreover, since the first piston and the second piston are movably fit, the distance between the second abutting portion and the fourth abutting portion is greater than the distance between the disengaging position and the triggering position, so that after the first docking piece reaches the docking position and if the first piston moves to the disengaging position, the first piston does not drive the first docking piece to move toward the second direction, that is, the first piston does not drive the first docking piece to move in the second direction before the first docking piece is docked with the tubing hanger, so that the first docking piece can move toward the direction of the tubing hanger under the third acting force to successfully complete the docking. It can be seen from the running tool of the present disclosure, before the running tool forms stable docking with the tubing hanger, the running tool does not move relative to the tubing hanger in advance, so that the tubing hanger can keep stable connection with the running tool in the lowering process and/or the retrieval process, thereby reducing the problems of tubing damage, surrounding environment pollution, personnel injury and the like caused by accidental separation, i.e. disengagement.

BRIEF DESCRIPTION OF THE DRAWINGS

In order to more clearly illustrate the embodiments of the present disclosure or technical solutions in the related art, the accompanying drawings used in the embodiments will now be described briefly. It is obvious that the drawings in the following description are only the embodiment of the present disclosure, and that those skilled in the art can obtain other drawings from these drawings without any creative efforts.

DETAILED DESCRIPTION OF THE EMBODIMENTS

Figure 1:
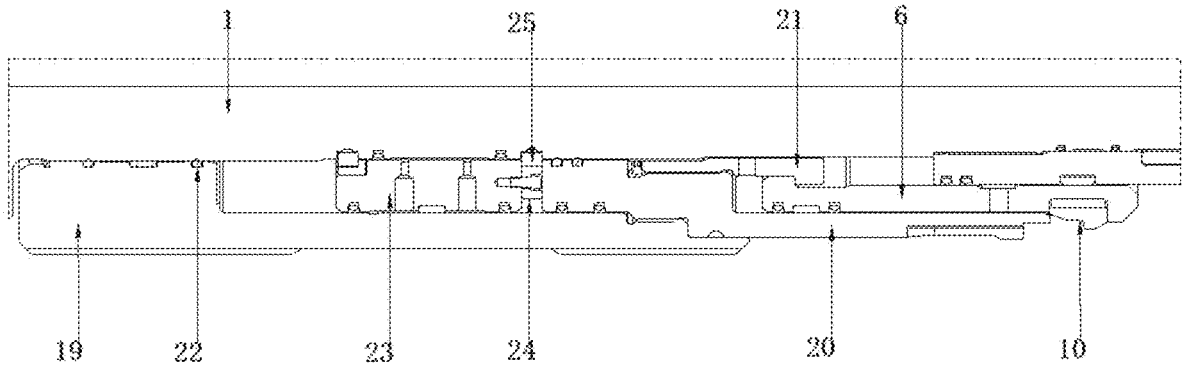
FIG. 1 is a sectional view of the partial structure of the running tool.

In the following, the technical solutions in the embodiments of the present disclosure will be clearly and completely described in conjunction with the accompanying drawings in the embodiments of the present disclosure. Obviously, the described embodiments are only a part of the embodiments of the present disclosure, but not all the embodiments thereof. Based on the embodiments of the present disclosure, all other embodiments obtained by those skilled in the art without any creative efforts shall fall within the scope of the present disclosure.

In order to make the above objectives, features, and advantages of the present disclosure more obvious and understandable, the following will provide further detailed explanations of the present disclosure in conjunction with the accompanying drawings and specific embodiments.

The first direction is arranged from the first piston 2 toward the direction of the tubing hanger. The first direction is opposite to the second direction. The first acting force is the force applied by the first driving piece to the first piston 2. If the running tool needs to be docked with the tubing hanger, the first driving piece applies the first acting force to the first piston 2, the first acting force drives the first piston 2 to move toward the first direction. After the triggering portion 5 reaches the triggering position, the first acting force drives the second piston 6 to move toward the first direction through the first abutting portion 3 and the second abutting portion 4, until the first docking piece 10 reaches the docking position, and the first stopping portion 9 and the second stopping portion 11 form a stopping pair. The second acting force refers to the acting force applied by the second driving piece to the first piston 2. If the first docking piece 10 reaches the docking position, the first stopping portion 9 and the second stopping portion 11 form a stopping pair. The second acting force drives the first piston 2 to move toward the second direction until the triggering portion reaches the disengaging position. The third acting force refers to the elastic restoring force of the first docking piece 10 itself.

As shown in FIG. 1 to FIG. 8, the running tool for a tubing hanger is disclosed by the present disclosure. The running tool includes the body 1, the body 1 is sequentially provided with the first piston 2, the second piston 6, and the second stopping portion 11. The first piston 2 is movably provided on the body 1, the first piston 2 is sequentially provided with the first abutting portion 3, the second abutting portion 4 and the triggering portion 5 along the first direction. The second piston 6 is movably provided on the body 1, the second piston 6 is movably fitted with the first piston 2, the second piston 6 is sequentially provided with the third abutting portion 7, the fourth abutting portion 8, the first stopping portion 9, and the first docking piece 10 along the first direction. The fourth abutting portion 8 and the first stopping portion 9 are positioned on one side of the second piston 6 close to the body 1, the first docking piece 10 is positioned on one side of the second piston 6 far away from the body 1, the third abutting portion 7 is positioned on the moving track of the first abutting portion 3 along the first direction, and the fourth abutting portion 8 is positioned on the moving track of the second abutting portion 4 along the second direction. The distance between the first abutting portion 3 and the third abutting portion 7 is not less than the distance between the disengaging position and the triggering position, the distance between the second abutting portion 4 and the fourth abutting portion 8 is greater than the distance between the disengaging position and the triggering position, and the first docking piece 10 is positioned on the moving track of the triggering portion 5. The second stopping portion 11 is positioned on the moving track of the first stopping portion 9 along the first direction.

Whether the running tool lowering the tubing hanger or retrieving the tubing hanger, the running tool needs to be docked with the tubing hanger (docking can be understood as connection), and if the running tool needs to be docked with the tubing hanger, the first acting force drives the first piston 2 to move towards the first direction, after the triggering portion 5 reaches the triggering position, the first acting force drives the second piston 6 to move toward the first direction through the first abutting portion 3 and the second abutting portion 4 until the first docking piece 10 reaches the docking position, and the first stopping portion 9 and the second stopping portion 11 form the stopping pair; and then, the second acting force drives the first piston 2 to move toward the second direction until the triggering portion 5 reaches the disengaging position, and the first docking piece 10 moves toward the direction close to the tubing hanger under the third acting force to form docking with the tubing hanger. Wherein, the first direction is arranged from the first piston 2 toward the tubing hanger; the first direction and the second direction are opposite. The disengaging position and the triggering position are sequentially arranged along the first direction, if the triggering portion 5 reaches the disengaging position, the first docking piece 10 and the tubing hanger form docking or interference, and if the triggering portion 5 reaches the triggering position, the first docking piece 10 and the tubing hanger are arranged in an avoiding way under the action of the triggering portion 5.

It should be noted that, since the first piston 2 and the second piston 6 are in movable fit, and the distance between the first abutting portion 3 and the third abutting portion 7 is not less than the distance between the disengaging position and the triggering position, the first piston 2 can move in the first direction relative to the second piston 6 before the first piston 2 drives the first docking piece 10 to move toward the first direction to the docking position, so that the triggering portion 5 can move to the triggering position, and the first docking piece 10 and the first docking portion 15 of the tubing hanger are arranged in an avoiding way. Moreover, since the first piston 2 and the second piston 6 are movably fit, the distance between the second abutting portion 4 and the fourth abutting portion 8 is greater than the distance between the disengaging position and the triggering position, so that after the first docking piece 10 reaches the docking position and if the first piston 2 moves to the disengaging position, the first piston 2 does not drive the first docking piece 10 to move toward the second direction, that is, the first piston 2 does not drive the first docking piece 10 to move in the second direction before the first docking piece 10 is docked with the tubing hanger, so that the first docking piece 10 can move toward the direction of the tubing hanger under the third acting force to successfully complete the docking. It can be seen from the running tool of the present disclosure, before the running tool forms stable docking with the tubing hanger, the running tool does not move relative to the tubing hanger in advance, so that the tubing hanger can keep stable connection with the running tool in the lowering process and/or the retrieval process, thereby reducing the problems of tubing damage, surrounding environment pollution, personnel injury and the like caused by accidental separation, i.e. disengagement.

Figure 2:
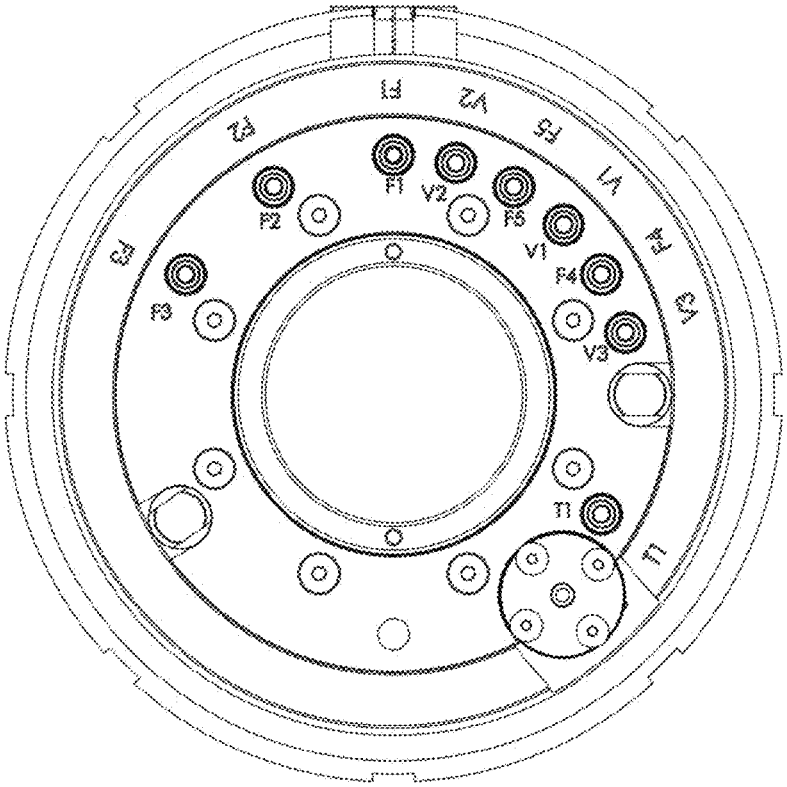
FIG. 2 is a top view of the running tool.
Figure 3:
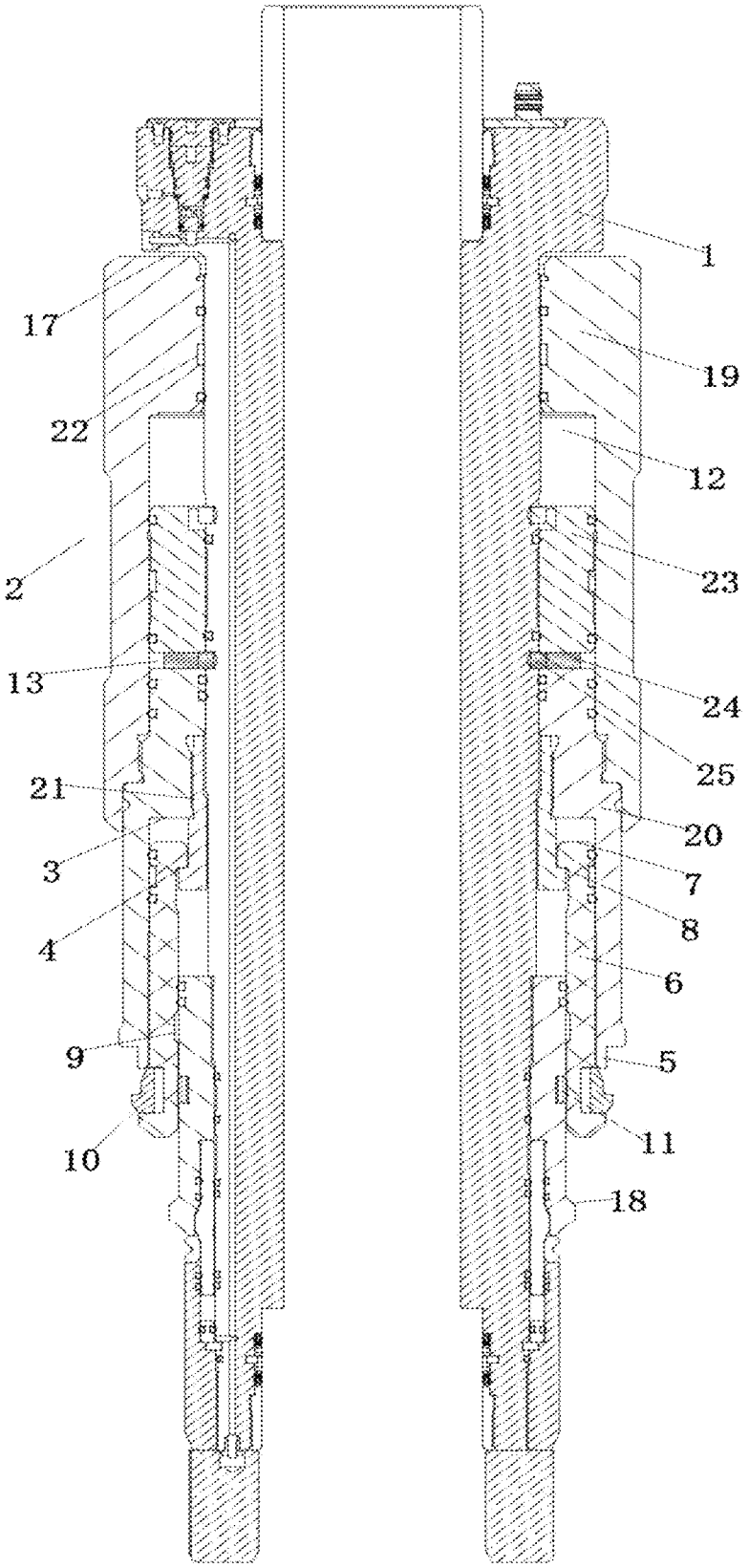
FIG. 3 is a structure diagram of the running tool.
Figure 4:
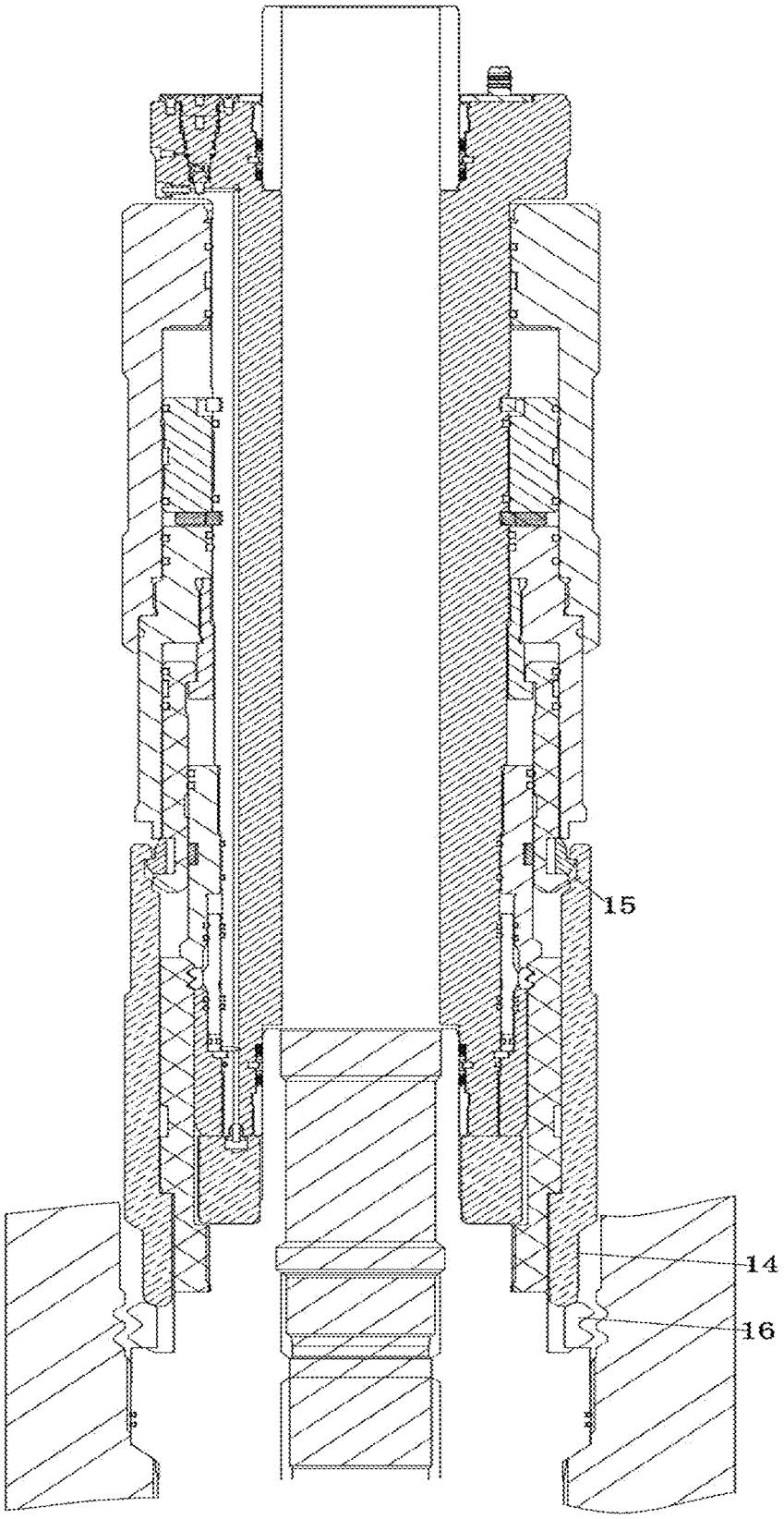
FIG. 4 is a structure diagram if the tubing hanger is not locked to the subsea tree.
Figure 5:
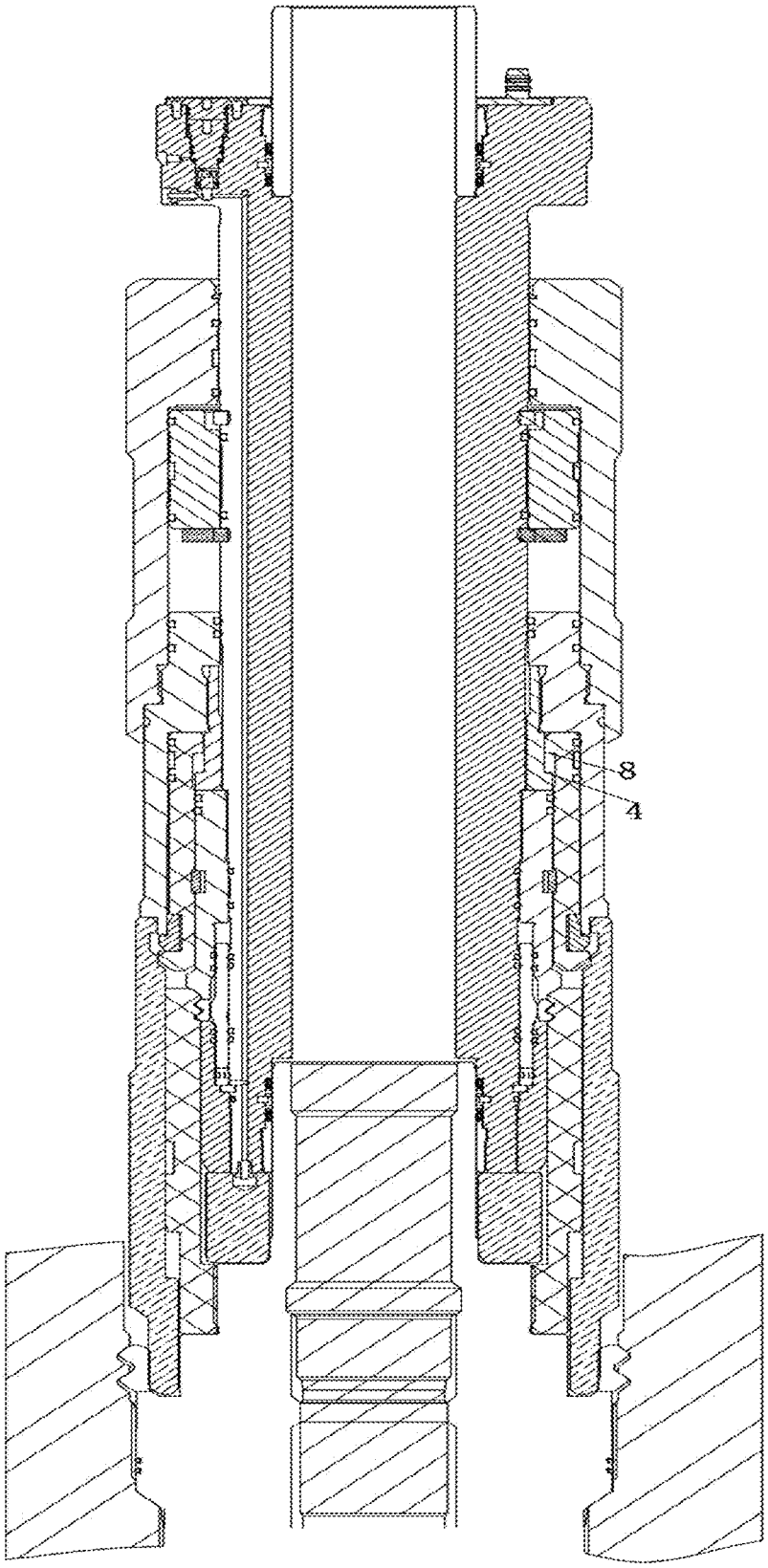
FIG. 5 is a structure diagram if the tubing hanger is locked to the subsea tree.
Figure 6:
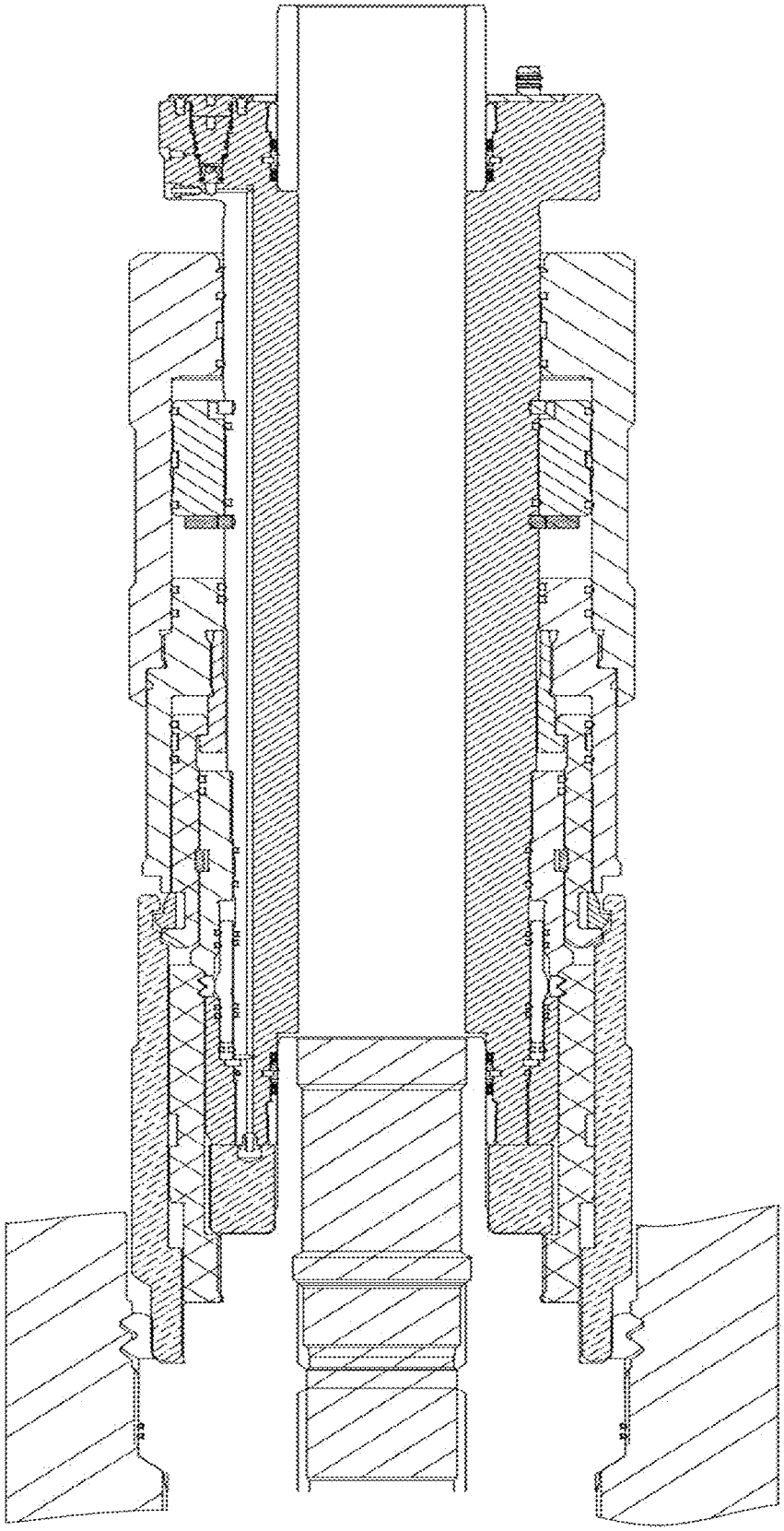
FIG. 6 is a structure diagram if the running tool is docked with the tubing hanger.
Figure 7:
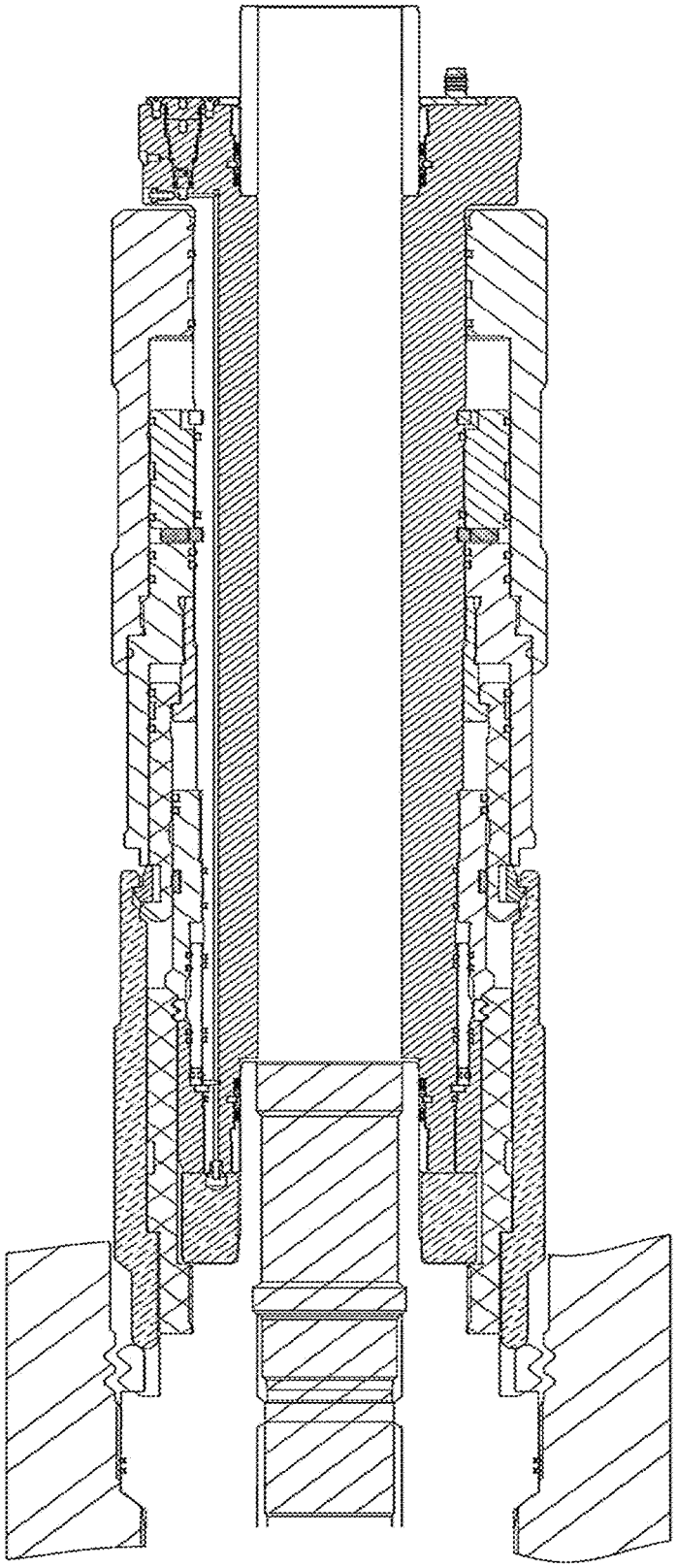
FIG. 7 is a structure diagram if the running tool drives the tubing hanger to move upwards.
Figure 8:
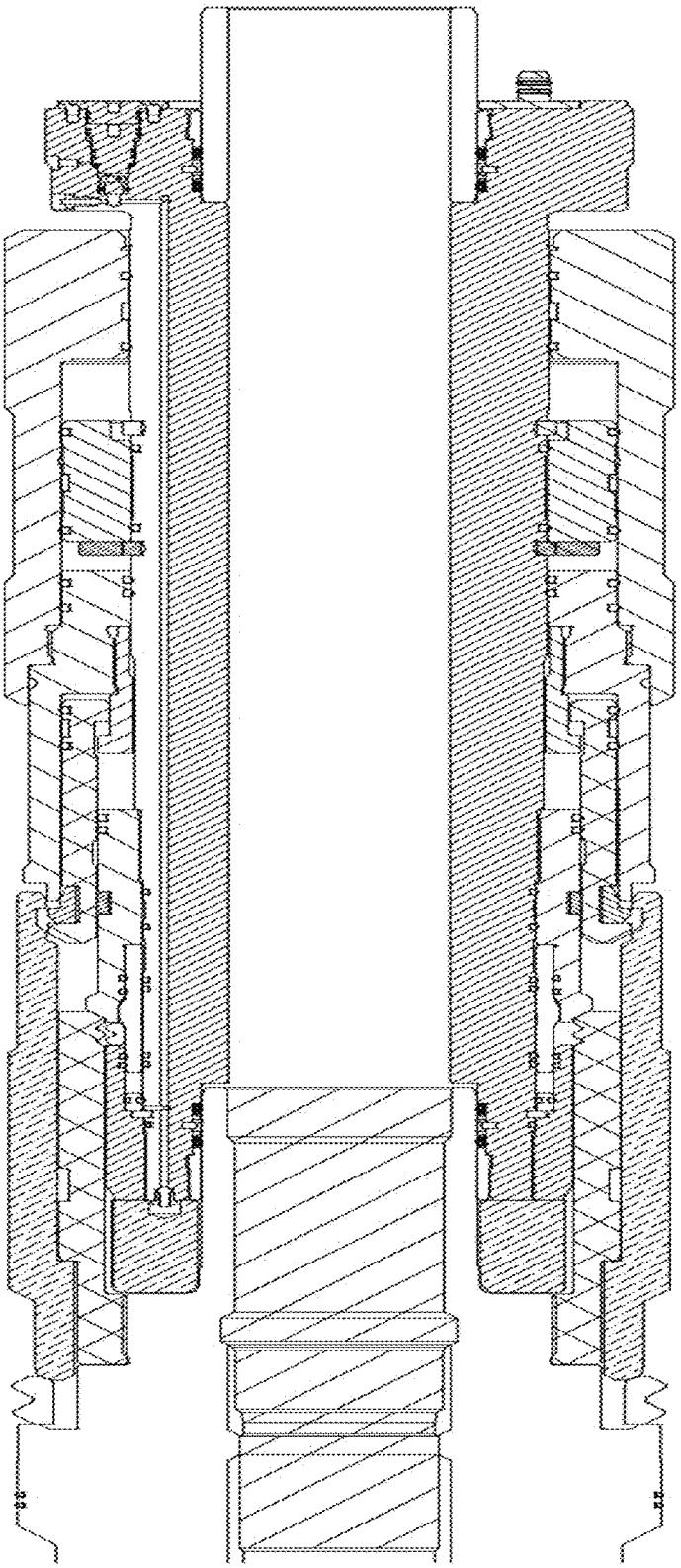
FIG. 8 is a structure diagram if the running tool is undocked from the tubing hanger; and wherein, 1. body; 2. first piston; 3. first abutting portion; 4. second abutting portion; 5. triggering position; 6. second piston; 7. third abutting portion; 8. fourth abutting portion; 9. first stopping portion; 10. first docking piece; 11. second stopping portion; 12. first driving portion; 13. second driving portion; 14. triggering piece; 15. first docking portion; 16. second docking piece; 17. first positioning portion; 18. second positioning portion; 19. external piston; 20. driving ring; 21. nesting ring; 22. first sealing piece; 23. stopping ring; 24. fixed ring; 25. split ring.

The body 1 of the present disclosure may be a cylindrical structure, i.e., a cylinder structure, to adapt to the shape of the tubing hanger and the the shape of the subsea tree; or, if the requirements for salvageing the tubing hanger can be met, the body 1 may be of other shapes. The triggering position is the position where the triggering portion 5 is positioned if the triggering portion 5 makes the first docking piece 10 and the first docking portion 15 of the tubing hanger in an avoiding way. The disengaging position is the position where the triggering portion 5 is positioned if the triggering portion 5 releases the acting force on the first docking piece 10 and the first docking piece 10 can rebound under the action of itself. The longitudinal sections of the first abutting portion 3 and the third abutting portion 7 are of a stepped structure, and the lower half of the longitudinal section or the upper half of the longitudinal section of both the first abutting portion 3 and the third abutting portion 7 are L-shaped, or the lower half of the both the first abutting portion 3 and the third abutting portion 7 are L-shaped, which reduces the design of a separate piston and simplifies the complexity of the integral running tool. FIG. 2 shows the inlet of the first channel, the second channel and the third channel in communication with the external working medium source.

The first docking piece 10 may specifically be an elastic structural piece, and the third acting force refers to the elastic restoring force of the first docking member 10 itself. If the triggering portion 5 moves to the triggering position, the triggering portion 5 compresses the first docking piece 10 toward the side close to the body 1, so that the outer diameter of the whole consisting of the body 1 area where the first docking piece 10 is positioned and the first docking piece 10 is smaller than inner diameter of the tubing hanger, and then the first docking piece 10 can smoothly enter the tubing hanger and reach the docking position along the first direction, completing the docking with the docking portion of the tubing hanger. As shown in FIG. 1 to FIG. 8, the first docking piece 10 is an integral structure, and compared with the split type structure, the strength and stability of the first docking piece 10 are improved, and the safety factor of the downhole tubing hanger operation is enhanced, so that stress deformation and even fracture of the first docking piece 10 are reduced if the inclination of the oil well is large and the low strength of the split type first docking piece 10, causing serious accidents such as the failure of recovery of the underwater tubing hanger or the separation of the underwater tubing hanger during the retrieval process. The first docking piece 10 may specifically be an open C-ring. It should be noted that the shape of the first docking piece 10 is not limited to the above, and the first docking piece 10 may also have a shape that satisfies the functions defined above.

The first piston 2 and the second piston 6 are movably provided on the body 1, and the second piston 6 is movably fitted with the first piston 2, which means that after the running tool is aligned with the tubing hanger, the subsea tree, and other equipment, the body 1 does not need to be moved again, and the locking and unlocking of the tubing hanger and the subsea tree can be completed by moving the first piston 2 and the second piston 6 on the body 1. Thereby reducing the problems of the loss of the body 1 and the subsea tree due to the frequent movement of the body 1, decreased alignment accuracy between the body 1 and the subsea tree, and installation accuracy of tubing hanger.

The first piston 2 may be an integral structure, or the first piston 2 may be a split structure. As shown in FIG. 1 to FIG. 8, the first piston 2 includes the external piston 19, the driving ring 20 and the nesting ring 21 which are sequentially arranged along the first direction; the nesting ring 21, the drive ring 20 and the external piston 19 are sequentially arranged from the direction close to the body 1 to the direction away from the body 1; the driving ring 20 is respectively in threaded connection with the external piston 19 and the nesting ring 21, the external piston 19 and the nesting ring 21 are slidably fitted with the body 1 in the first direction, the nesting ring 21 is positioned between the body 1 and the second piston 6, and the nesting ring 21 is also slidably fitted with the second piston 6.

The first abutting 3 and the second abutting 4 are corresponding areas on the first piston 2. If the first piston 2 includes the external piston 19, the driving ring 20 and the nesting ring 21, the first abutting 3 is positioned on the side of the driving ring 20 facing the second piston 6 and the second abutting 4 is positioned on the side of the nesting ring 21 facing the second piston 6. The third abutting 7 and the fourth abutting 8 are corresponding areas on the second piston 6. As shown in FIG. 1 to FIG. 8, the second abutting portion 4 and the third abutting portion 7 are corresponding areas on the second piston 6.

The first stopping portion 9 and the second stopping portion 11 may be fitted by a protrusion and a groove, as shown in FIG. 1 to FIG. 8, the body 1 is provided with a protrusion, the side of the second piston 6 facing the body 1 is provided with a groove fitted with the protrusion, and the groove and the protrusion are provided with a guide surface, so that the protrusion and the groove can be smoothly switched between two states of separation and formation of a stopping pair. The elastic piece can also be arranged between the protrusion and the body 1, so that if the groove reaches the protrusion, the protrusion can automatically enter the groove under the action of the elastic piece to form the stopping pair. It is understood that the second stopping portion 11 limits the movement of the first stopping portion 9, which in turn limits the movement of the second piston 6 relative to the body 1. It should be noted that the arrangement of the first stopping portion 9 and the second stopping portion 11 is not limited to the fit of the protrusion and the groove, and other structures capable of playing a stopping role are also possible.

As shown in FIG. 1 to FIG. 8, the body 1 is sequentially provided with the first positioning portion 17 and the second positioning portion 18 along the first direction, the first positioning portion 17 is positioned on the side of the first piston 2 away from the first direction, the first positioning portion 17 is positioned on the moving track of the first piston 2; and the second positioning portion 18 is positioned on the side of the second piston 6 facing the first direction, the second positioning portion 18 is positioned on the moving track of the second piston 6. The first positioning portion 17 and the second positioning portion 18 can be protrusions provided on the main body 1. The first positioning portion 17 prevents the first piston 2 from excessively moving in the first direction, thereby ensuring the smooth operation of the first piston 2 in the process of lowering and retrieving the tubing hanger; the second positioning portion 18 prevents the second piston 6 from excessively moving in the second direction, thereby reducing the over-excitation of the second docking piece 16, and ensuring the subsequent smooth locking of the second docking piece 16 and the subsea tree.

The running tool of the present disclosure further includes the first driving piece and the second driving piece, the second driving piece can apply the first acting force to the first piston 2, and the third driving piece can apply the second acting force to the first piston 2. The second driving piece and the third driving piece may be driving equipment such as hydraulic cylinders or electric cylinders, but it shall be noted that the running tool shall be provided with a cavity for accommodating the driving equipment, and the cavity shall be well sealed to prevent external impurities such as seawater from entering the driving equipment.

Alternatively, the first driving piece and the second driving piece may not use the driving equipment described above. As shown in FIG. 1 to FIG. 8, the first driving piece includes the first channel provided on the body 1 and the first driving portion 12 provided on the first piston 2, and two ends of the first channel are respectively communicated with the external working medium source and the first driving portion 12. The second driving piece includes the second channel provided on the body 1 and the second driving portion 13 provided on the second piston 6, and two ends of the second channel are respectively communicated with the external working medium source and the second driving portion 13. The first driving portion 12 and the second driving portion 13 are arranged independently.

If the first acting force needs to be applied to the first piston 2, the external working medium source injects the working medium into the second channel, and the working medium pushes the first piston 2 to move toward the first direction; similarly, if the second acting force needs to be applied to the first piston 2, the external working medium source injects the working medium into the first channel, and the working medium pushes the first piston 2 to move toward the second direction. In this case, the first driving portion 12 and the second driving portion 13 are troughs for receiving the working medium. The working medium may be a medium such as hydraulic oil that can drive the first piston 2 to move without causing significant damage to the first piston 2 and the body 1. A corresponding delivery pump is provided at the external working medium source in order to smoothly deliver the working medium to the first driving portion 12 or the second driving portion 13.

The independent arrangement of the first driving portion 12 and the second driving portion 13 means that the working media in the first channel and the second channel do not interfere with each other. The first driving portion 12 and the second driving portion 13 are arranged independently, which can be realized by the arrangement of the first driving portion 12 or the second driving portion 13, for example, a protrusion is arranged on the body 1 between the first driving portion 12 and the second driving portion 13, so that the protrusion separates the first driving portion 12 from the second driving portion 13, and the working media in the first channel and the second channel will not interfere with each other. Or the side of the first driving portion 12 close to the second driving portion 13 can be attached to the body 1, and/or the side of the second driving portion 13 close to the first driving portion 12 can be attached to the body 1, so as to avoid the interference between the first channel and the second channel.

As shown in FIG. 1 to FIG. 8, the body 1 is provided with a separation assembly, the separation assembly is provided between the first driving portion 12 and the second driving portion 13, the separation assembly includes the stopping ring 23 and the fixed ring 24 sequentially arranged along the first direction, the stopping ring 23 is fixed on the body 1, and the split ring 25 is embedded between the fixed ring 24 and the body 1. The split ring 25 includes a plurality of protrusions; thus, the stopping ring 23, the fixed ring 24, and the split ring 25 separate the first channel and the second channel.

Further, the running tool further includes the third driving piece which applies the acting force toward the first direction to the second piston 6 if the triggering portion 5 reaches the disengaging position. If the triggering portion 5 reaches the disengaging position, the first piston 2 cannot continue to move toward the first direction due to the separation assembly, so that the third driving piece can apply the acting force toward the first direction to the second piston 6, which enhances the stopping force of the first docking piece 10 before the first docking portion 15 is completely docked with the first docking piece 10, making it less likely for the first docking piece 10 to be driven toward the first direction by the first piston 2 before forming a docking with the first docking portion 15 of the tubing hanger, further ensuring the stability of the docking between the tubing hanger and the running tool. The third driving piece may specifically be the linear driving equipment such as the hydraulic cylinder or the electric push rod, and at this time, it is noted that the third driving piece is arranged in a sealing cavity to prevent external media such as seawater from entering and affecting the movement of the third driving piece. Alternatively, as shown in FIG. 1 to FIG. 8, the first driving piece may also include the third channel provided on the body 1, the first end of the third channel is communicated with the external working medium source, and the second end of the third channel is communicated with the area between the first abutting portion 3 and the second abutting portion 4. At this time, if the first docking piece 10 and the first docking portion 15 are docked, the external working medium source injects the working medium into the first channel, and the working medium applies the acting force toward the second direction to the second piston 6.

And/or, the running tool includes a sealing assembly, the sealing assembly includes the first sealing piece 22 provided between the body 1 and the first piston 2, and the second sealing piece provided between the body 1 and the second piston 6, the first sealing piece 22 and the second sealing piece specifically may be sealing rings, and in addition to providing sealing pieces at the above-mentioned positions, the present disclosure also provides sealing pieces between multiple structures to ensure the sealing performance of the running tool.

As shown in FIG. 1 to FIG. 8, the tubing hanger includes a base body, the base body is sequentially provided with the triggering piece 14 and the second docking piece 16 from the third direction, the triggering piece 14 is movably provided on the base body, one end of the triggering piece 14 close to the running tool is provided with the first docking portion 15 fitted with the first docking piece 10, the second docking piece 16 is positioned on the moving track of the triggering piece 14; if the first driving piece drives the second piston 6 to move toward the first direction, the triggering piece 14 moves toward the direction close to the second docking piece 16, and the triggering piece 14 locks the second docking piece 16 with the subsea tree; the third direction is the direction of the body 1 toward the subsea tree. The second docking piece 16 is a structure with an elastic restoring force; after the triggering piece 14 reaches the corresponding position of the second docking piece 16, the second docking piece 16 is ejected outward by the triggering piece 14 to complete the locking with the subsea tree; if the triggering piece 14 moves away from the subsea tree, the triggering piece 14 retracts toward the direction close to the base body under its own elastic force to release the locking with the subsea tree.

In addition, the first piston 2, the second piston 6, the subsea tree, and the tubing hanger are all arranged coaxially with the body 1, which ensures the accuracy of lowering the tubing hanger and installing the tubing hanger. The running tool also includes a detection assembly provided on the body 1, the detection assembly is used for detecting the inclination angles between the first piston 2, the second piston 6 and the body 1, the detection assembly specifically can be an angle senso; if an operator or a controller in signal connection with the detection assembly finds that the first piston 2 or the second piston 6 is inclined relative to the body 1 through the feedback of the detection assembly, the postures of the first piston 2 and the second piston 6 are adjusted by the auxiliary equipment in time to prevent the first piston 2 or the second piston 6 from moving on the body 1 in an inclined posture to cause the first piston 2 or the second piston 6 to be stuck with the body 1, and unable to be butted with the tubing hanger, or to release the abutting problems. Guide pieces are provided between both the first piston 2, the second piston 6 and the body 1, the guide piece is arranged along the first direction, the guide piece can include a guide rail arranged along the first direction, the body 1 is provided with a plurality of sections of guide rails, the first guide rail is provided on one side of the body 1 far away from the tubing hanger, the first guide rail is in sliding fit with the first piston 2 in the first direction; the second guide rail is provided on one side of the body 1 close to the tubing hanger, and the second guide rail is in sliding fit with the second piston 6 in the first direction. And/or the guide piece includes a balance cavity provided on one side of the first piston 2 far away from the body 1 and/or on one side of the second piston 6 far away from the body 1, the balance cavity is communicated with the external pressure source. A plurality of balloons are provided along the circumference both of the first piston 2 and the second piston 6, the balance cavity refers to the balloon cavity, and if the detection assembly detects that the first piston 2 and/or the second piston 6 inclines relative to the body 1, the external pressure source increases the pressure of the balloon positioned at the side opposite to the inclination direction of the first piston 2 and/or the second piston 6, so that the first piston 2 and/or the second piston 6 restores the coaxiality with the body 1. The external pressure source can be equipment storing liquid or gas, and the liquid or gas is flushed into or discharged from the balloon cavity through the delivery pump to adjust the posture of the first piston 2 and/or the second piston 6.

In the present disclosure, the second piston 6, the external piston 19, the driving ring 20, the nesting ring 21, the stopping ring 23, and the fixed ring 24 are all annular structures; however, the second piston 6, the external piston 19, the driving ring 20, the nesting ring 21, the stopping ring 23, and the fixed ring 24 are not limited to annular structures, and other shapes that can realize the functions defined above by the above structures can also be used.

In this article, and/or refers to the textual content located in front of and/or the same sentence, and the textual content located behind and/or the same sentence can exist simultaneously or separately; for example, A and/or B include the case where only A or only B exists, and the case where A and B exist simultaneously. Or have the same meaning as and/or, and will not be repeated here.

The present disclosure discloses a number of technical solutions, but there is no case where the contrary technical enlightenment is given.

In the present disclosure, specific examples are used to illustrate the principles and embodiments of the present disclosure, and the description of the above embodiments is only used to help understand the method and the core idea of the present disclosure; meanwhile, for those of ordinary skill in the art, the specific embodiments and the application scope may be changed according to the idea of the present disclosure. To sum up, the contents of this specification should not be construed as limiting the disclosure.

What is claimed is:

1. A running tool for a tubing hanger, wherein the running tool comprises a body, and the body is sequentially provided with a first piston, a second piston, and a second stopping portion;

the first piston is movably provided on the body, the first piston is sequentially provided with a first abutting portion, a second abutting portion and a triggering portion along a first direction;

the second piston is movably provided on the body, the second piston is movably fitted with the first piston, the second piston is sequentially provided with a third abutting portion, a fourth abutting portion, a first stopping portion, and a first docking piece along the first direction; the fourth abutting portion and the first stopping portion are positioned on one side of the second piston close to the body, the first docking piece is positioned on one side of the second piston far away from the body, the third abutting portion is positioned on a moving track of the first abutting portion along the first direction, and the fourth abutting portion is positioned on a moving track of the second abutting portion along a second direction; a distance between the first abutting portion and the third abutting portion is not less than a distance between the disengaging position and the triggering position, the distance between the second abutting portion and the fourth abutting portion is greater than the distance between a disengaging position and a triggering position, and the first docking piece is positioned on a moving track of the triggering portion;

the second stopping portion is positioned on a moving track of the first stopping portion along the first direction;

if the running tool needs to be docked with the tubing hanger, a first acting force drives the first piston to move toward the first direction, and after the triggering portion reaches the triggering position, the first acting force passes through the first abutting portion, and the second abutting portion drives the second piston to move toward the first direction until the first docking piece reaches a docking position, and the first stopping portion and the second stopping portion form a stopping pair; then, a second acting force drives the first piston to move toward the second direction until the triggering portion reaches the disengaging position, and the first docking piece moves toward a direction close to the tubing hanger under a third acting force to form docking with the tubing hanger;

wherein, the first direction is arranged from the first piston toward the tubing hanger; the first direction and the second direction are opposite; the disengaging position and the triggering portion are sequentially arranged along the first direction, if the triggering portion reaches the disengaging position, the first docking piece and the tubing hanger form docking or interference, and if the triggering portion reaches the triggering position, the first docking piece and the tubing hanger are arranged in an avoiding way under action of the triggering portion.

2. The running tool for a tubing hanger according to claim 1, wherein the running tool further comprises a first driving piece and a second driving piece, the first driving piece can apply the first acting force to the first piston, and the second driving piece can apply the second acting force to the first piston.

3. The running tool for a tubing hanger according to claim 2, wherein the first driving piece comprises a first channel provided on the body and a first driving portion provided on the first piston, and two ends of the first channel are respectively communicated with an external working medium source and the first driving portion;

the second driving piece comprises a second channel provided on the body and a second driving portion provided on the second piston, and two ends of the second channel are respectively communicated with the external working medium source and the second driving portion;

the first driving portion and the second driving portion are arranged independently.

4. The running tool for a tubing hanger according to claim 3, wherein the body is provided with a separation assembly, and the separation assembly is positioned between the first driving portion and the second driving portion;

the running tool further comprises a third driving piece that applies a force to the second piston toward the first direction if the triggering portion reaches the disengaging position.

5. The running tool for a tubing hanger according to claim 3, wherein the tubing hanger comprises a base body, a triggering piece and a second docking piece are sequentially provided on the base body from a third direction, the triggering piece is movably provided on the base body; one end of the triggering piece close to the running tool is provided with a first docking portion fitted with the first docking piece, and the second docking piece is positioned on a moving track of the triggering piece;

if the first driving piece drives the second piston to move toward the first direction, the triggering piece moves toward a direction close to the second docking piece, and the triggering piece locks the second docking piece with the subsea tree; the third direction is a direction in which the body faces the subsea tree.

6. The running tool for a tubing hanger according to claim 1, wherein the body is sequentially provided with a first positioning portion and a second positioning portion along the first direction; the first positioning portion is positioned on a side of the first piston away from the first direction, the first positioning portion is positioned on a moving track of the first piston; and the second positioning portion is positioned on a side of the second piston facing the first direction, the second positioning portion is positioned on a moving track of the second piston.

7. The running tool for a tubing hanger according to claim 1, wherein the first piston comprises an external piston, a driving ring and a nesting ring which are sequentially arranged along the first direction, the nesting ring, the driving ring and the external piston are sequentially arranged from a direction close to the body toward a direction away from the body; the driving ring is respectively in threaded connection with the external piston and the nesting ring, the external piston and the nesting ring are in slide fit with the body;

and/or, the running tool comprises a sealing assembly which comprising a first sealing piece positioned between the body and the first piston, and a second sealing piece positioned between the body and the second piston;

and/or the first docking piece is a unitary structure.

8. The running tool for a tubing hanger according to claim 1, wherein the first piston and the second piston are coaxially arranged with the body; the running tool further comprises a detection assembly provided on the body, the detection assembly is used for detecting inclination angles between the first piston, the second piston and the body; guide pieces are provided between both the first piston and the second piston and the body, and the guide piece is arranged along the first direction.

9. The running tool for a tubing hanger according to claim 8, wherein the guide piece comprises a guide rail arranged along the first direction; and/or the guide piece comprises a balance cavity provided on one side of the first piston away from the body, and the balance cavity is communicated with an external pressure source.

* * * * *